United States Patent [19]

Halasz

[11] Patent Number: 4,760,725

[45] Date of Patent: Aug. 2, 1988

[54] SPIN FLOW FORMING

[75] Inventor: Andrew Halasz, Crystal Lake, Ill.

[73] Assignee: Ball Corporation, Muncie, Ind.

[21] Appl. No.: 859,026

[22] Filed: May 2, 1986

[51] Int. Cl.[4] ..... B21D 19/06

[52] U.S. Cl. ..... 72/84; 72/94; 72/105

[58] Field of Search ..... 72/84, 94, 105, 110

[56] References Cited

U.S. PATENT DOCUMENTS

| | | | |
|---|---|---|---|
| B 223,678 | 3/1976 | Nixon et al. . | |
| 1,939,577 | 12/1933 | Sneed . | |
| 2,312,225 | 2/1943 | Wilkinson . | |
| 2,353,349 | 7/1944 | Merolle | 72/94 |
| 3,469,428 | 9/1969 | Aschberger | 72/94 |
| 3,688,538 | 9/1972 | Hoyne | 72/94 |
| 3,763,807 | 10/1973 | Hilgenbrink . | |
| 3,782,314 | 1/1974 | Franek et al. . | |
| 3,874,209 | 4/1975 | Maiorino . | |
| 3,913,336 | 10/1975 | Nelsen et al. . | |
| 3,913,366 | 10/1975 | Nelsen et al. | 72/94 |
| 3,962,896 | 6/1976 | Bichel . | |
| 3,994,251 | 11/1976 | Hake et al. . | |
| 4,018,176 | 4/1977 | Gynp et al. . | |
| 4,030,432 | 6/1977 | Miller et al. . | |
| 4,070,888 | 1/1978 | Gombas | 72/110 |
| 4,144,732 | 3/1979 | Franks et al. . | |
| 4,341,103 | 7/1982 | Escallon et al. . | |
| 4,487,048 | 12/1984 | Frei | 72/105 |
| 4,512,172 | 4/1985 | Abbott et al. . | |
| 4,563,887 | 1/1986 | Bressan et al. . | |

FOREIGN PATENT DOCUMENTS

| | | |
|---|---|---|
| 477348 | 10/1974 | Australia . |
| 0075068 | 3/1983 | European Pat. Off. . |
| 0140469 | 5/1985 | European Pat. Off. . |
| 2345871 | 1/1973 | Fed. Rep. of Germany . |
| 2703141 | 7/1977 | Fed. Rep. of Germany . |
| 2805321 | 8/1978 | Fed. Rep. of Germany . |
| 1512772 | 6/1978 | United Kingdom . |

*Primary Examiner*—Lowell A. Larson

*Attorney, Agent, or Firm*—Sheridan, Ross & McIntosh

[57] ABSTRACT

Open-ended cylindrical shells, such as might become beverage cans or containers, are necked (and/or may be flanged) at the open end by tooling including a cooperating internal mandrel and external forming roller; at the opposite end of the shell there is a chuck to clamp and spin the shell. The chuck spins the shell while the forming roller forces the rim portion at the open end of the shell progressively into contact with the opposed mandrel to form the neck and/or the flange. The tooling is repeated in sets at regular spaced intervals between and about a pair of rotating wheels, there being a shell supported between the tools at each tool position so that continuous production is achieved within a production loop or orbit which occupies limited space. Variations in shell thickness or metallurgy can be complied with by employing a variable speed drive both for the chuck and a rotatable collar which fits the open end of the shell. Gears are part of the variable speed drive. These gears are employed in the variable speed drive and by arranging the gears to be driven counter to the wheels, a gear ratio results by which the shells may be rotated rapidly so the forming operation may be performed quickly.

28 Claims, 5 Drawing Sheets

Fig. 3.
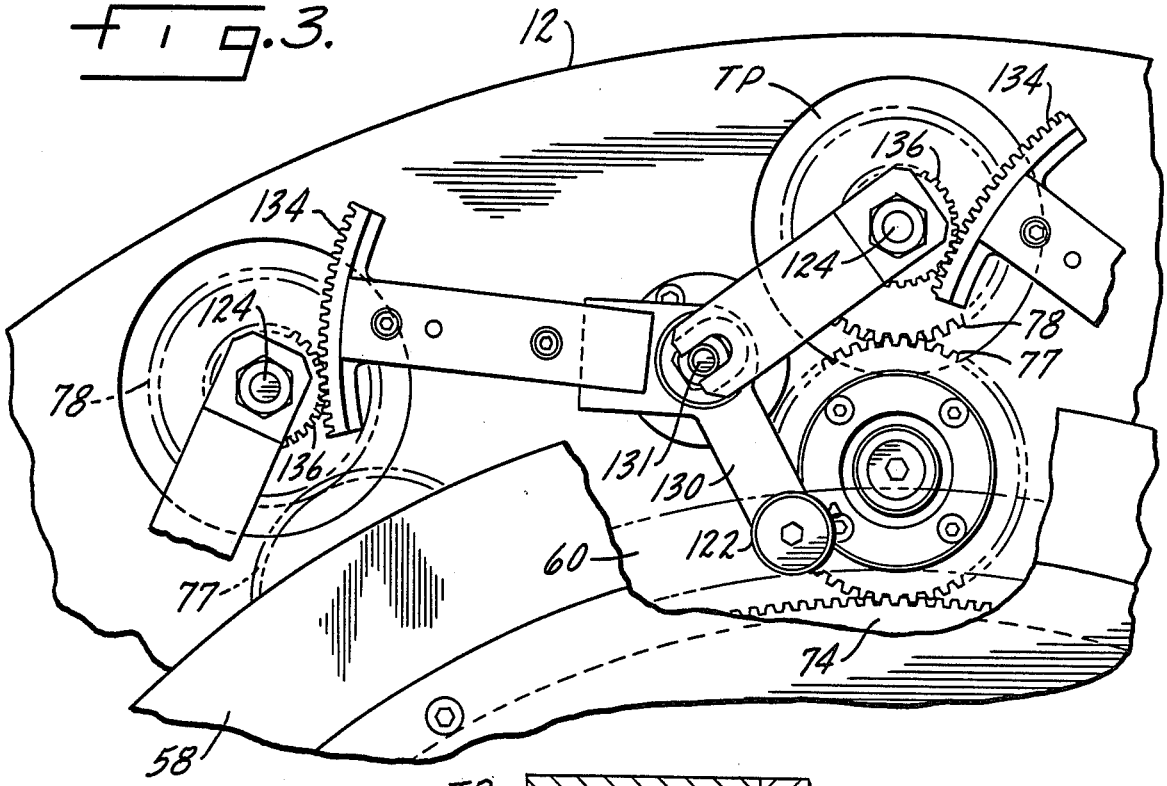
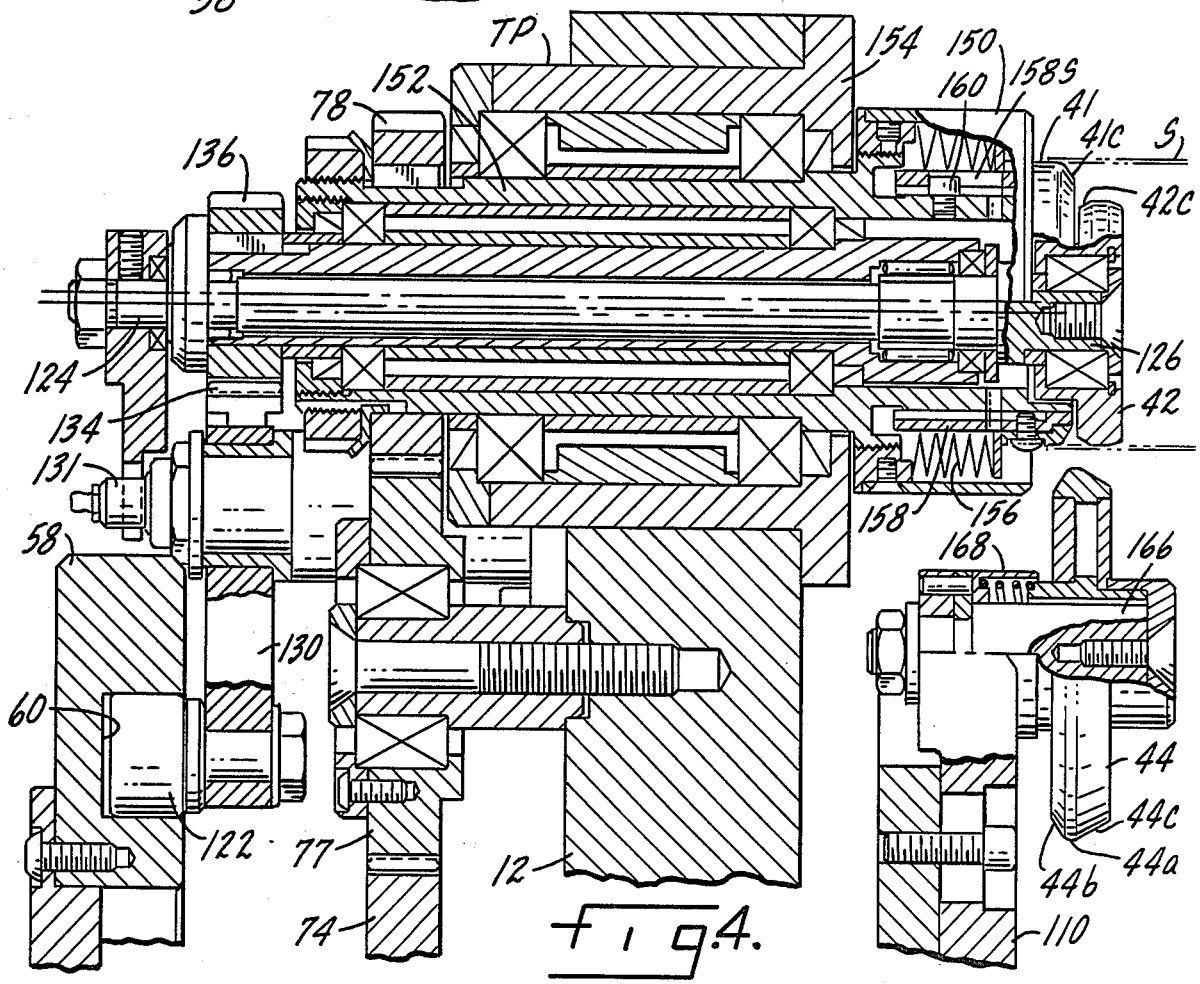
Fig. 4.

SPIN FLOW FORMING

BACKGROUND OF THE INVENTION

This invention relates to a machine for configuring, by rolling, an open end of a thin metal cylinder or shell and in particular a shell from which a can, such as a beverage can, is to be completed. The term "shell" or "cylindrical shell" is used herein generically to designate either a regular one-piece cylinder (geometrically "regular") open at both ends (used to make a so-called three-piece can) or a one-piece elongated cup-shaped member open at one end and having a closed bottom wall at the opposite end from which a two-piece can may be completed by adding a lid. The configuration may be one of necking-in, flanging, or both, for example.

According to U.S. Pat. No. 4,563,887 the open end of a thin-walled cylindrical metal shell is spin-rolled to form a reduced neck and flange. This is done by rotating the shell about its longitudinal axis while engaging the outer side of the shell, at the open end, with a forming roller or die opposed to a mandrel at the inside of the open end of the shell. The forming roller and mandrel have opposed surfaces, and are mounted for relative axial movement, by which the necking and flanging operations are completed as an incident to feeding or advancing the die-forming roller toward the mandrel with the open end of the shell squeezed between them. The operative or effective position of the mandrel is achieved by mounting it eccentrically on a shaft and oscillating the shaft until the mandrel is orbited into engagement with the inside wall of the shell.

The shell is spun or rotated rapidly about its longitudinal axis by means including a rotating chuck which clamps the shell at the end opposite the open end which is to be configured. The chuck thus constitutes a tool which spins the shell, while the mandrel and opposed forming roller are the tools by which the open end of the can or shell is deformed. Collectively they represent tooling with which the present invention is for the most part concerned.

THE NATURE OF THE PRESENT INVENTION AND ITS OBJECTIVES

One of the principal objects of the present invention is to embody the tooling of U.S. Pat. No. 4,563,887 in a rotary production machine and in particular to position such tooling at spaced intervals about and between a pair of large wheels while utilizing cams to position and control the tooling identified above.

The shells to be configured are fed one by one from a supply station to a receiving station adjacent the perimeter of the wheels. At the receiving station, the shells are collected one by one and presented in axial alignment to successive tool sets as the wheels rotate. Preferably the tool sets are spaced at thirty degree intervals about the wheels, but this is selective and variable.

Cam tracks are provided by related drums coaxial with the rotating wheels. The cam tracks are stationary. Cam followers are attached to the tools to advance and retract them; in the course of a cycle of operation the chuck clamps the shell and advances it laterally toward the mandrel until the mandrel has been operatively positioned inside the shell, the forming roller (variously referred to herein as the die roller, external die roller or forming tool) is then advanced radially into engagement with the outer surface of the shell, the shell is necked or otherwise formed, the tooling is retracted and the shell is discharged at a discharge station. Hence, another object of the present invention is to assure positive and precise control over the tools by synchronized cam structure by which close and precise movements may be assured within the limits or tolerances of sophisticated machine tools for cutting and grinding the various cam tracks employed in the machine.

Related objects of the invention are to support the chuck on a cam-operated slide which also carries a cradle to locate the shell between the tooling; to utilize independently driven gears for spinning the chuck and for also spinning an internal forming roller or collar telescoped into the opposite end of the shell; and to so arrange the wheels, the cam tracks and their followers that many functions and precise controls may be accomplished in a relatively compact structure capable of orbiting the shells within a selected, preferably limited arc, at high speed.

The thin metal shells may vary in terms of thickness and metallurgy. The optimum spinning rate and "feed" of the forming die for a thin aluminum shell may by no means, and indeed will not be, the optimum for a thicker shell of steel. Therefore, in accordance with the present invention and constituting one of the more important objects, a variable speed drive is employed for driving a pair of gears which respectively are responsible for spinning synchronously the chuck which clamps the shell and the support collar or internal roller which is telescoped into the opposite, open end of the shell. Therefore by employing a variable speed drive, the shell can be spun at a selective speed when being shaped depending upon its metallurgy or thickness or both. The cam track for radially advancing and retracting the external forming roller can, like the others, be machined or milled to a close tolerance; consequently its geometric form can be profiled to vary the "feed," of the forming roller to meet the requirements of the metallurgy, dimension (wall thickness) of the shell and the shape of the neck and/or flange to be configured. These two factors in combination, the variable speed drive and the ability to select a cam configuration for determining the rate of in-feed for the forming tool, enable the present machine to be custom fitted, so to speak, to the dimension and metallurgy of the shell.

BRIEF DESCRIPTION OF THE DRAWING

FIG. 3 is a detail elevation on an enlarged scale showing means by which the mandrel is eccentrically positioned;

FIG. 4 is a section of FIG. 3;

DETAILED DESCRIPTION OF THE INVENTION

Figure 1:
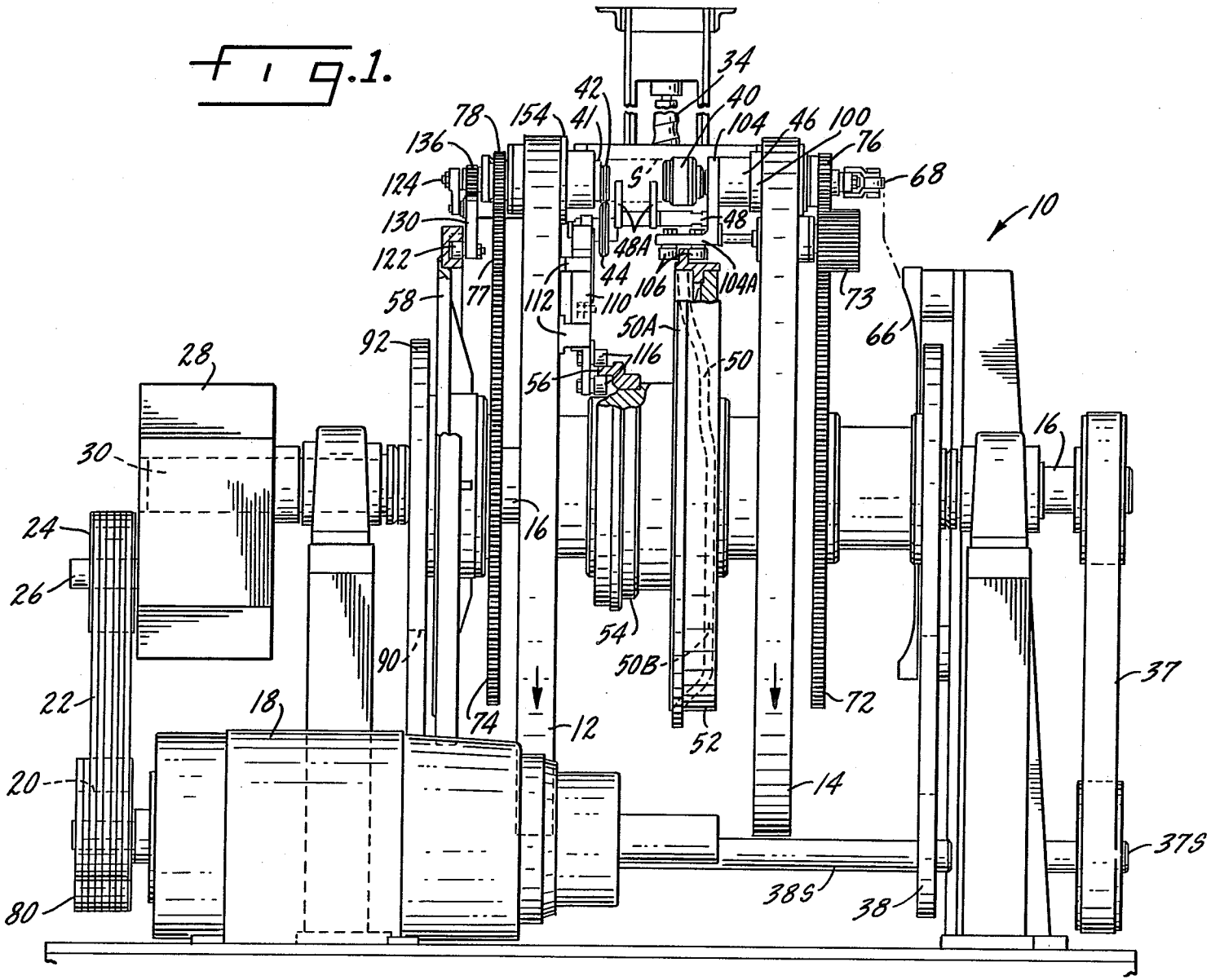
FIG. 1 is a front elevation of the machine.

The present machine, 10 FIG. 1, is a cyclically operable machine in that its production is repetitious at regular intervals and time spans based on the rotation of two large wheels 12 and 14 mounted on a common drive shaft 16 for synchronous rotation. A motor 18 constitutes the main drive for shaft 16. The output shaft of motor 18 rotates a pulley 20 coupled by a V-belt set 22 to a driven pulley 24. Pulley 24 is secured to the driven shaft 26 of a gear reduction box 28 of known kind. The internal gearing (not shown) in the gear housing 28 terminates in an output shaft 30 which is keyed or otherwise coupled to the drive shaft 16 for the rotating wheels.

Figure 2:
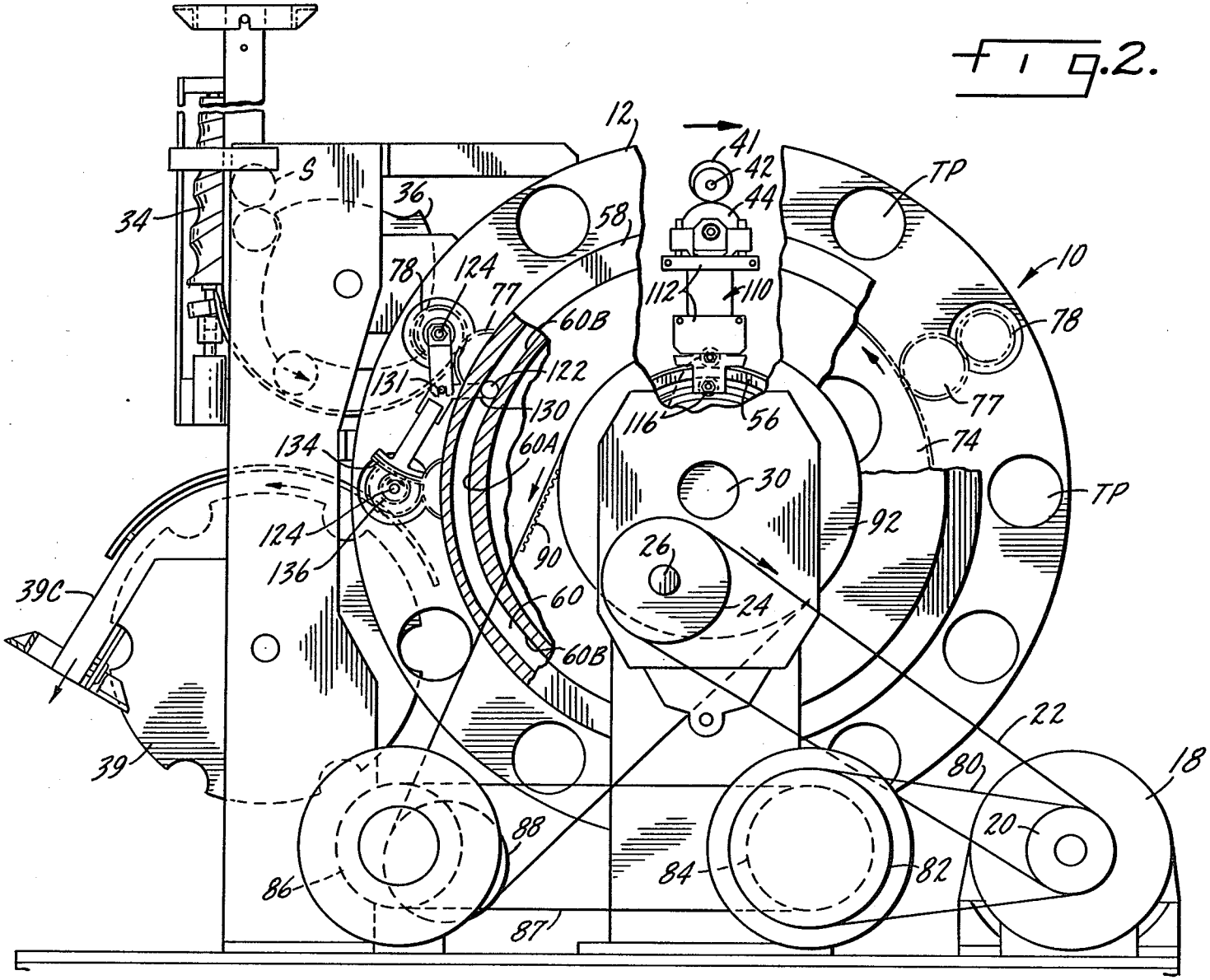
FIG. 2 is a side elevation of the machine, partly in section.

There are twelve tool positions TP, thirty degrees apart, FIG. 2. The number of tool positions or those actually occupied will depend upon production requirements. The tooling is identical at each tool position and will be described in detail below. It will also be noted in FIG. 2 that the wheels are rotating in the clockwise direction.

The cylindrical metal shells S, FIG. 2, are fed from a supply magazine (itself fed from a gravity chute, not shown) to the perimeter of a feed screw 34. A pocket or star wheel 36 (four pockets as shown) is in a receiving position adjacent the lower end of screw 34 and represents what may be termed the receiving station. This wheel 36, together with the feed screw 34, are effectively synchronized to the large wheels 12 and 14 so that the shells to be shaped or configured are advanced one by one by the feed wheel successively to each tooling position TP rotating therepast. Synchronization of the feed screw 34 and feed wheel 36 is achieved by sprocket wheels, idlers and chains (not all shown) driven from sprockets on the drive shaft 16 for the large wheels 12 and 14, including belts 37 and 38, FIG. 1, and related driven shafts 37S and 38S.

The completed shells are released to the pockets of a second pocket wheel 39 and delivered into a delivery chute 39C, constituting discharge station. Pocket wheel 39 is rotated synchronously with pocket wheel 36.

In connection with the following description, it is to be understood that in FIG. 1 the thin metallic shell S to be configured (e.g. necked and flanged) is shown in the ready position to be rolled, and the tooling is also shown in ready position. The tooling now to be described is identical at each tool position.

The tooling, FIG. 1, comprises a chuck structure 40 to be clamped to one end of the shell for spinning the shell S, a spinning collar or internal roller 41 which fits into the end of the shell to be shaped, a free wheeling mandrel 42 which is inside the open end of the can or shell after it has been positioned for configuration, an external forming roller or die 44 supported for radial movement toward and away from the end of the shell to be configured, and finally a slide 46 which supports the spindle for the chuck as well as a shell support 48 having a pair of spaced arms as 48A which position the shell between the tools. As already mentioned, this tooling structure is repeated in sets at regularly spaced intervals TP about and between the two wheels 12 and 14.

Movement of the tool slide 46 and its associated parts is controlled by a cam track 50 which is continuous, but irregular, external track extending about the entire perimeter of a cam drum 52 located between the two wheels 12 and 14. This drum is stationary but coaxial with the wheels 12 and 14. A second cam drum 54, coaxial with cam drum 52 is positioned between the latter and the left-hand one of the wheels 12. This second cam drum presents a laterally protruding continuous cam track 56, FIG. 1, which controls the radial in and out movement of the external forming die 44.

A third cam drum 58, coaxial with wheels 12 and 14, is located outside wheel 12 as shown in FIG. 2, and a continuous internal cam track 60 associated with this cam drum is responsible for orbiting the mandrel 42 into and out of contact with the inside of the shell.

At the outside of wheel 14, FIG. 1, there is a fourth stationary cam 66. This cam 66 is related to a follower 68 which is used to open the chuck to release the shell after the configuration has been imparted.

Finally, from the standpoint of overall description, there are two large sun gears 72 and 74, FIG. 1, coaxial with the main drive shaft 16 but independently rotated in a direction counter to the wheels 12 and 14. Gear 72 (through an interposed wide idler 73) rotates pinion gear 76, FIG. 1, which spins the chuck spindle to spin the shell. Gear 76 is supported for rotation on the outside of wheel 14. Gear 74 through an interposed idler 77, FIG. 2, rotates a second pinion 78, FIG. 2, which spins the internal support roller or collar 41 inside the open end of the can, synchronously with the spinning chuck. Gear 77 is supported for rotation on wheel 12.

A variable speed drive is afforded for the gears 72 and 74 so that their speed may be varied in accordance with the objective stated above. To this end, a V-belt set 80, FIGS. 1 and 2, is driven from pulley 20, FIG. 1, which is the main drive pulley of the main drive motor 18. The V-belts 80 drive a larger pulley 82, FIG. 2, and this pulley in turn rotates a variable speed pulley set 84 having a 1:1 driving relationship with a related variable pulley set 86 by means of transmitting belts 87. The variable speed pulley drive 86 in turn is employed to transmit rotation to a pulley 88 (through transmitting gears not shown) and pulley 88 drives a timing belt 90 which drives a larger pulley 92 on the shaft of gear 74 which is supported for rotation independent of and counter to shaft 16 for the wheels.

Instead of variable speed pulleys, an independent variable speed motor could be substituted, but in any event pulley 92 is driven in an accurately timed manner independently of and counter to the drive shaft 30 for the large wheels 12 and 14.

Timing pulleys and timing belts of identical ratio (not shown) are provided for gear 72, FIG. 1, so that it is driven synchronously with gear 74. This may be accomplished by (and in the actual construction is accomplished by) extending a shaft (not shown) from pulley 88, FIG. 1, across the back of the machine to a like pulley to which a timing belt as 90 is coupled for rotating gear 72 in the fashion of gear 74. The two gears 72 and 74 are employed to synchronously rotate the chuck 40 and the collar 41 at the same speed as will now be explained in connection with further details of the machine.

As mentioned above, the shell S and the tooling, FIG. 1, are shown in the ready position, ready to commence necking and flanging of the shell S. The chuck structure 40 has been advanced from a retracted position, forcing the open end (left hand end) of the shell S onto the end of collar 41, of very slightly reduced diameter neatly to engage the inside of the shell at its open end. Thus, the chuck structure 40 is in its advanced position and was moved to this position by the slide 46. The slide 46 is in the form of a cylinder guidably mounted in a larger bushing 100 rigidly and tightly supported in an opening FIG. 1, formed in the periphery of wheel 14. Such opening may be considered the same as the tool position TP. Similar bushings as 100 and slides as 46 are located at selected ones or all the other tool positions TP about the circumference of wheel 14.

The slide 46 carries a bracket 104, FIG. 1, and this bracket has a horizontal leg 104A as will be evident in FIG. 1 from which depend a pair of cam followers 106. These cam followers, in the position shown, embrace the projecting cam track 50 at the commencement of its "high" portion 50A. The cam track 50 has a "low" portion 50B and it will be seen that with the wheels rotating toward the observer as viewed in FIG. 1 the followers 106 will eventually achieve the "low" or retracted part of the cam track 50, characterizing retraction of the slide 46 which occurs after the can has been configured.

The support for the forming die 44, FIG. 2, is identified by reference character 110. This supporting structure 110 reciprocates as shown by the double-ended arrow, FIG. 2, and accurate linear motion is assured by a guide 112, FIG. 1, secured to the inside of wheel 12.

The die roller support 110 includes a pair of cam followers 116 embracing the cam track 56 which may be viewed (FIG. 2) as an eccentric ring on drum 54, the eccentricity of which defines the in-feed (tool advance) and retracting movement of the die roller 44. In FIG. 1, the eccentricity of cam track 56 in cooperation with the followers 116 has positioned tool support 110 so that the die 44 has just achieved contact with the open end of the thin-walled shell to be configured. At the same time, the opposing mandrel 42, inside the shell, has been orbited into contact with the inside surface of the shell in a manner soon to be explained.

It will be recognized from the spacing of parts shown in FIG. 1 that the first and second cam drums, drums 52 and 54, coaxial with the wheels 12 and 14, are neatly nested therebetween within the space necessary to accommodate the tooling. Thus a compact unit is assured in the first instance.

The third cam drum 58 is located outside wheel 12 immediately adjacent gear 74 and presents the internal cam track 60, FIG. 2. Disposed in the internal cam track 60 is a follower 122 employed to oscillate a mandrel shaft 124, FIG. 2, which supports an eccentric stub 126, FIG. 4, on which the mandrel 42 is mounted for free-wheeling rotation.

To achieve oscillation, cam follower 122 is carried pivotally at the end of one arm of a rock shaft 130 which in turn is pivotally carried by a pin support 131, FIG. 2, projecting outwardly from the outer side of wheel 12. As can be readily visualized from FIG. 2, the high part of the cam track 60A and the low part 60B an opposite sides thereof will be responsible for cam follower 122 oscillating the rock shaft. The arm of rock shaft 130 opposite that which carries the follower 122 is provided with a segment gear 134 meshed with a small pinion 136. The pinion 136 is fast, by keying or otherwise, on the mandrel shaft 124. Hence when the segment gear is oscillated in one direction, the eccentric stub 126 is orbited to place mandrel 42 against the inside surface of the shell to present an anvil for the action of the approaching forming roller 44, and when the segment gear is oscillated in the opposite direction the mandrel is displaced, which takes place after the shell is configured as a result of spinning the open end of the shell between the free-wheeling mandrel on the inside and the forming roller advancing radially inwardly against the outside of the shell.

In FIG. 4 the eccentric roller has achieved contact with the inside of the shell, and the forming roller 44 is just about ready to make contact with the outside of the shell. Earlier, the shell S had been forced onto the end of collar 41 which is being rotated synchronously with the chuck. The support collar 41 is carried by a sleeve 150 keyed to a hollow drive shaft 152 which, as shown in FIG. 4, is concentric to the mandrel shaft 124. Both shafts are mounted on roller bearings for independent rotation relative to one another. Shaft 152 is mounted inside a large cylindrical bushing 154 mounted in an opening in wheel 12 which defines a tool position TP shown in FIG. 3. Shaft 152 is rotated by gear 78.

While support collar 41 and its associated sleeve 150 are keyed, as by splining or otherwise, to hollow shaft 152, axial yieldability is afforded to enable the open end of the can to be configured as will be described in more detail below. Yieldability is afforded by a Belleville spring assembly 156 or any other means. The sleeve 150 is provided with an internal collar 158 having a slot 158S formed therein. A stop pin 160 carried by shaft 152 has the head thereof disposed in slot 158S to limit the outer or extended position of collar 41. It will be appreciated that when the shell S is positioned on collar 41, the latter is capable of cooperating with the chuck to help spin the shell.

The mandrel 42, FIG. 4, has a chamfer **42*c* extending about its inner rim. This constitutes the anvil part of the mandrel 42, that is, the portion which cooperates with the external forming roller 44. The outer rim of collar 41 includes a chamfer 41*c*. Collar 41 is constantly rotating compared to the mandrel 42** which is free-wheeling (or driven if preferred) and rotates only when the shell is being squeezed thereagainst during spin forming.

Figure 5:
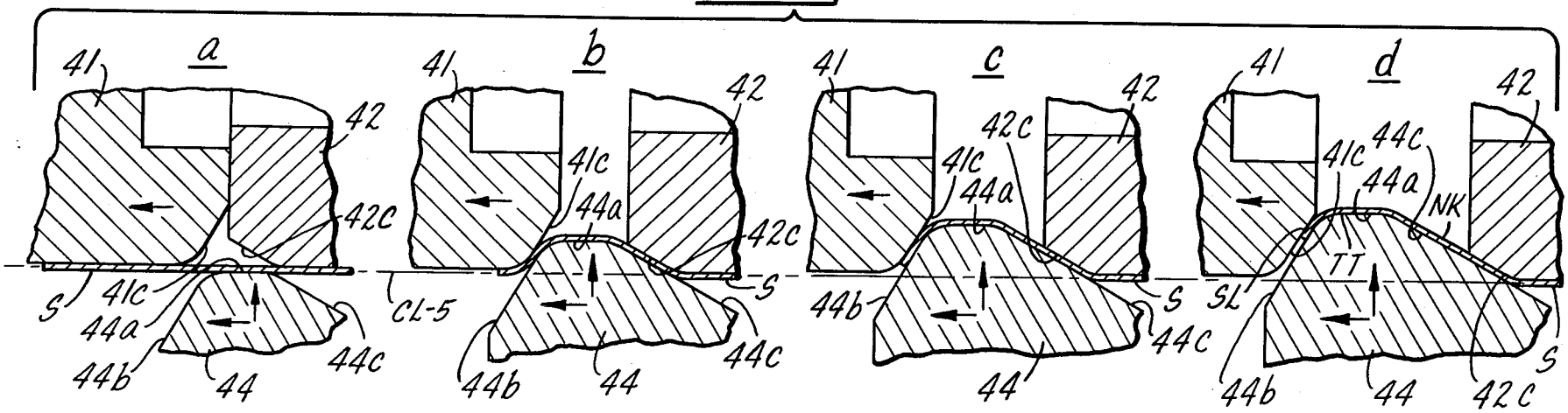
FIGS. 5 and 5A are schematic views showing typical successive stages of the way in which the external forming roller, internal collar and mandrel cooperate to configure the shell.

Both chamfers **41*c* and 42*c* are truncated cones which slope radially inwardly toward one another to terminate in smaller diameters and define between themselves a generally V-shaped recess into which the narrow rim 44*a* of the forming tool 44 forces the neck of the can as it is formed. In this connection it will be noted the forming roller has a leading chamfer 44*b* and a trailing chamfer 44*c* on respective sides of the rim 44*a*. As shown in FIG. 5 both these chamfers are truncated cones, similar in the geometric sense to their opposed chamfers 41*c* and 42*c*. Chamfers 44*c*–42*c* neck the shells at NK, chamfers 44*b*–41*c* flange the shell, forming an annular flange SL, and the rim 44*a***, which is flat, forms a short regular cylindrical throat TT on the shell, located between the flange SL and neck NK. The neck NK is a straight, regular cone.

In FIG. 5, selected of the progressive steps in the forming process are shown in terms of a center line CL-5 extended through the sectioned side wall of the shell. From this can be seen the extent to which the external forming tool advances radially into the gap between the two internal tools as it forms the neck, throat and flange of the container.

Figure 5A:
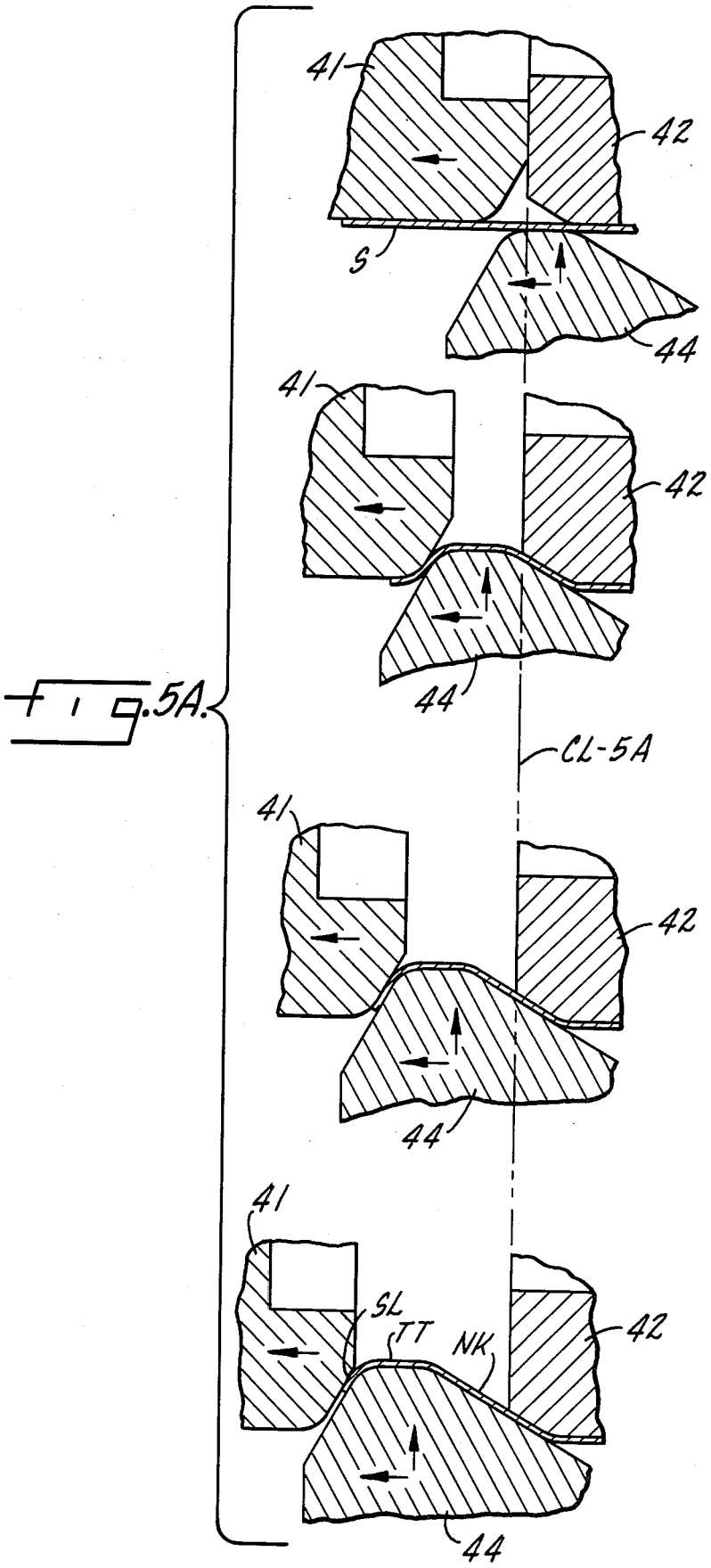

In FIG. 5A the same progressive steps are shown in terms of a center line CL-5A colinear with the plane of the free end of the internal mandrel and from this can be seen the way in which both the external forming tool and internal support collar move axially away from the fixed mandrel as the cone is generated at the neck of the container body.

When the rim **44*a* of the forming roller engages the portion of the shell which spans the V-shaped recess or space between the chamfers 41*c* and 42*c*, the shell is now pressed forcefully against the mandrel which begins to rotate (FIG. 5*a*) and since the forming roller 44 is engaged with the rotating shell, the forming roller also spins. As the spinning roll tool 44 advances radially inwardly (FIG. 5*b*, 5*c*) the complemental chamfers 42*c***

(mandrel) and 44c (external forming roller) begin to form the neck NK on the shell; finally, the free end edge of the shell is flanged at SL between chamfers 41c and 44b in the fashion shown in FIGS. 5c and 5d. Concurrently the throat TT is formed.

The forming roller 44 is supported for rotation on a stub shaft 166 by the tool support 110. A coil spring 168 is located on shaft 166 between the hub of tool 44 and a socket at one end of the supporting shaft 166. Spring 168 allows the forming roller 44 to shift axially to the left as viewed in FIG. 4 in the course of the in-feeding movement of the tool support 110. As this axial movement occurs, and when the rim or forming nose 44a of the forming tool penetrates the V-shaped recess (mentioned above) to maximum extent, chamfer 44b on the tool 44 engages the chamfer 41c on the support collar 41. The support collar 41 shifts axially to the left as viewed in FIG. 4, as allowed by the Belleville spring assembly 156, and as this occurs a radially outwardly extending flange is formed at the outermost end of the shell by and between chamfers 41c and 44b, FIG. 5.

After the open end of the shell has been configured, suitable for the next production process, the chuck is retracted, while still clamping the shell, and retraction continues until the open end of the shell is free of the support collar or roller 41. The shell is now in condition to be released from the machine, and this takes place when the released shell reaches one of the pockets on the discharge wheel 39.

Release of the shell of course requires collapse of the chuck segments. In this connection, the chuck is a standard expansible chuck with the expansible segments thereof fitting into the open end of the shell in the instance of a shell open at both ends.

Figure 6:
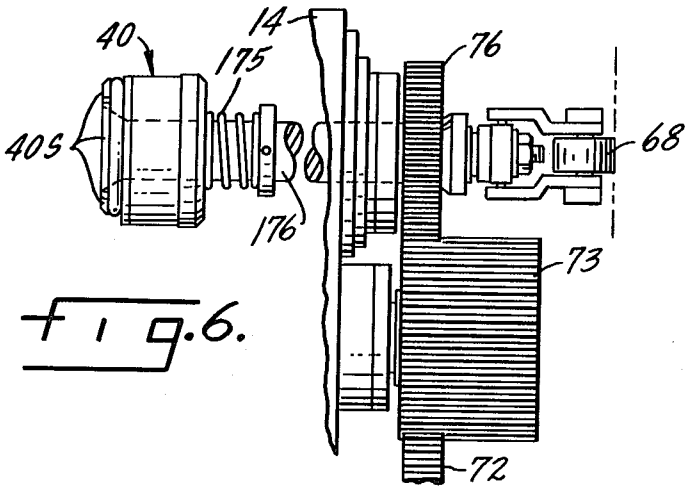
FIG. 6 is a schematic detail of the chuck.

While the chuck structure is not new, it is schematically illustrated in FIG. 6. The chuck elements or segments 40S are normally wedged into the expanded mode, forced to this position by a coil spring 175 which draws the chucking wedge inward against the chuck segments. The wide pinion 76 is constantly rotating the chuck shaft, and as noted above, a cam follower 68 is harnessed to the free end of the chuck shaft, the latter denoted by reference character 176 in FIG. 6.

A summary of operation is as follows. A cycle of operation commences with the in-feed of a shell to a pocket on the star wheel 36, feeding the shell to be configured onto the support fingers 48A, FIG. 1. The chuck 40 is collapsed at this time (by cam 66 as will be explained) and the slide 46 is fully retracted. After the shell is seated in the cradle 48, the chuck is expanded to clamp the shell. The cam followers 106 achieve the "high" part of cam 50, and the chuck slide 46 is translated to the left as viewed in FIG. 1 until the roller 41 is inside the shell. The mandrel 42 has been shifted to its eccentric position.

The forming roller 44 on tool support 110 starts its advance shortly after the shell is in its support and eventually achieved contact with the shell to commence the forming operation characterized by its advance or feed to the required depth while roll-spinning the neck of the can. After necking the mandrel 42 is orbited to a concentric position free of the inside of the shell while at the same time the tool support 110 is being retracted.

The tool support 110 is in its fully retracted position has achieved its dwell position. The mandrel is once more orbited to its eccentric position ready for the next shell.

The chuck remains in its expanded or clamping position until late in a cycle of rotation of the wheels 12 and 14 and eventually engages the "high" part of cam track 66 which so shifts the chuck shaft as to extend the wedge which frees the chuck elements from their expanded clamping position. It may be mentioned in this connection that if the machine is to be used for production of a shell having an inwardly domed bottom, then chucking may be accomplished by vacuum.

After the forming tool is fully retracted, the mandrel is moving into its concentric position, and the chuck has been retracted to the right (as viewed in FIG. 1) so that the configured or open end of the can is free of the support collar 41. At this moment a pocket on the discharge wheel 39 grabs the completed shell and discharges it.

The same cycle is repeated for the second shell loaded onto its cradle, for the third shell loaded onto its cradle, and so on, repeatedly as the wheels rotate. Clamping the shell in the chuck and moving it laterally on to the internal forming roller 41 is done quickly since the wheels are turning rapidly and hence the shell must be secured against centrifugal force.

Based on present experience the feed rate of the external forming tool, for ordinary aluminum containers having a wall thickness at the neck of approximately 0.005", may be 0.010" per turn of the container body, while for ordinary steel container bodies the feed rate should be reduced to about 0.004" per turn of the container body. With slightly increased wall thickness, the feed rate may be maintained but the spin rate will be reduced. In the instance of double reduced steel (hard steel) and/or heavier gauge steel the feed rate should be reduced, say to 0.003" and the spin rate should also be reduced. It should be mentioned in this connection that a high spin rate is about 1800 RPM while a considerably lower spin rate would be about 1200 RPM. Also, it should be mentioned that the total tool in-feed will depend upon the extent to which the neck diameter is to be reduced and this may vary from say 0.060" to 0.250" tool feed.

It will be seen from the foregoing that among other things the bushing supports 100 and 154 assure precise alignment of the tooling, concentricity of the shafts 124 and 152, FIG. 4, precision in rotation of the two pinions 76 and 78, and precision between rock shaft 130 and the paired oscillating gears 134 and 136. The combined slide 46, cradle 48 and related cam follower support 104 enable the wheels 12 and 14 to be separated by little more than the length of two shells as can be readily perceived in FIG. 1, allowing two of the cam drums to be located therebetween. Consequently, a high rate production machine is possible within limited space, and this is achieved while making provision for rotating gears 72 and 74 at a selected speed so that the related pinions 76 and 78 may be rotated at a speed independent of wheels 12 and 14.

Concerning counterrotation of the gears 72 and 74 synchronously at the same speed, the shell is rotated at high speed as can be seen by comparing the relative diameters of the sun gears and the pinions rotated thereby. This is to be compared to the circumstance where the sun gears are stationary with the pinions 73 and 77 simply orbiting or walking around the gears 72 and 74. Thus, by rotating the sun gears a full gear ratio between the large sun gear and the smaller pinion is realized, nor would this full gear ratio be realized if the sun gears 72 and 74 rotated in the same direction as wheels 12 and 14. The faster the can is spun, the slower the feed rate needed for tool 44, which is preferable for many materials. This emphasizes the advantage of the variable speed drive because it, coupled with the counterrevolution, allows very fine tuning of the forming process. For example, the feed or advance of the external forming roller may be held constant at "x" inches for one full turn of a can having a particular metallurgy and thickness. But a can of different metallurgy and/or thickness may require two turns of the can, or maybe one and one-half turns, while feeding the external tool through "x" inches of feed.

In summary, the machine may be employed in successive runs to spin roll different shells, which may differ as to the kind of metal (ductile or soft, versus less ductile and harder) or which may differ as to the wall thickness in the area to be rolled. The diameter is altered and the tools for accomplishing this alteration, whether necking or flanging or both, include a forming roller and an opposed mandrel between which is clamped or captured the portion of the shell to be configured by the opposed surfaces of the two tools moving relative to one another.

Depending upon the character of the selected shell employed for the first run, the parameters of tool feed and spin rate will be selected as optimum for that metal, so that with the portion of the shell to be rolled disposed between the complemental chamfers of the opposed tools, the diameter of the shell will be altered during concurrency of the applied parameters for the spin rolling process, that is, the shell is completely necked and/or flanged within "a" number of shell turns or degrees of spin while the relative tool advance occurs concurrently through tool feed distance "b".

For a shell of considerably different wall thickness and/or ductility, to be spin rolled in the next run of the machine, one or both of the parameters will be changed.

I claim:

1. A cyclically operable machine for imparting a predetermined necked-in configuration to the open ends of thin cylindrical metal shells while spinning the shells about their axes and rolling the configuration, said machine having: spaced coaxial tools for spinning a shell and configuring its open end respectively including a rotatable spindle-mounted chuck for clamping the end of the shell opposite said open end to spin the shell and, for said open end, a rotatable mandrel eccentrically carried on a radially oscillatable mandrel shaft and positionable inside the shell in opposition to an external die forming roller provided to cooperate with the mandrel to impart said configuration, said die forming roller being capable of radial movement mechanically independent from movement of the corresponding mandrel; a shell support to locate a shell thereon between the tools, with the tooling repeated in identical sets are regular intervals about and supported between a pair of rotatable wheels synchronized for rotation about a common axis; a first substantially annular cam track presented by a first stationary cam drum, said first cam track being substantially centered on the axis of the wheels, said chuck and its spindle of each set of tooling being carried by a corresponding slide for lateral movement toward and away from the mandrel of the corresponding set of tooling, and said slide having a cam follower engaged with said first cam track to induce such lateral movement to present said open end of a shell in encompassing relation to the mandrel and afterwards to withdraw the shell from the mandrel; a second substantially annular cam track presented by a second stationary cam drum, said second cam track being substantially centered on the axis of the wheels, each set of tooling further including support means supporting the corresponding external die forming roller for said radial movement toward and away from the open end of a shell, said die roller support means of each set of tooling including a second cam follower coupled with said second cam track to induce such movement of said support means for the corresponding die roller; said first and second cam tracks being oriented wherein, as the wheels revolve a set of tooling about said common axis of the wheels and first and second cam tracks to cause the corresponding first and second cam followers to follow the associated cam tracks, the first cam track causes the corresponding slide and supported shell to laterally advance toward the corresponding mandrel until the mandrel is inside the open end of the shell, the second cam track then causes the corresponding die forming roller to advance toward and engage the outside of the shell and thereby cooperate with the mandrel to impart the predetermined necked-in configuration to said open end of the shell while it is spinning, and the first cam track finally causes the slide and shell to retract laterally away from the mandrel, sequentially; means to oscillate the shaft on which the internal mandrel is eccentrically mounted thereby to orbit the internal mandrel into contact with the inside of the shell at said open end thereof at least as of the time the forming roller is to become engaged with the shell, and to radially orbit said mandrel out of contact after said predetermined necked-in configuration has been imparted and prior to the retraction of the slide and shell laterally away from the mandrel; and means to spin the chuck to spin the shell.

2. Machine according to claim 1 including a support collar to be telescoped into the open end of the shell to be configured, a pair of drive gears which are centered on the axis of the wheels which support the tooling, one drive gear being used to rotate a pinion gear which travels with the tooling and which rotates the chuck to spin the shell, the second drive gear being used to rotate another pinion gear for rotating said support collar, and a variable speed drive for rotating all said gears synchronously, whereby the speed at which the shell is spun may be selectively varied independently of the speed of the wheels.

3. Machine according to claim 1 in which the shell support is connected to the chuck slide for movement therewith.

4. Machine according to claim 2 in which the pinion for the collar which supports the open end of the shell is concentric to said mandrel shaft, means to oscillate said mandrel shaft, including a pinion on that shaft engaged by a segment gear carried by a rock shaft, a third stationary cam drum presenting a third cam track, and a follower on said rock shaft engaged with the third cam track whereby the rock shaft is oscillated to oscillate the mandrel shaft.

5. Machine according to claim 2 in which the drive gears are mounted and arranged to rotate synchronously counter to the wheels.

6. Machine according to claim 5 including a third stationary cam drum, coaxial with the wheels, and a third cam track associated therewith, and a third cam follower and means actuated thereby to oscillate the mandrel shaft.

7. Machine according to claim 6 having a support collar to be telescoped into the open end of the shell to be configured, a pair of drive gears which are centered on the axis of the wheels, one drive gear outward of each wheel, pinion gears respectively rotated at the same speed by respective ones of said drive gears, one pinion gear for rotating said chuck to spin the shell and the other pinion gear for rotating said collar at the same speed as the chuck, said drive gears being supported for rotation opposite that of the wheels and a variable speed drive for said drive gears.

8. A machine according to claim 6 in which the mandrel and die roller are shaped to provide the shell with a necked-in portion which is a regular truncated cone.

9. A machine according to claim 6 in which the collar and die roller are shaped to provide the shell with an annular flange at its open end.

10. A machine according to claim 9 in which the mandrel, die roller and collar are shaped to provide the shell with a necked-in portion which is a regular truncated cone, an annular flange at the open end and a regular cylinder between the flange and necked-in portion.

11. A machine according to claim 1 in which the mandrel and die roller are shaped to provide the shell with a necked-in portion which is a regular truncated cone.

12. A machine according to claim 1 in which the collar and die roller are shaped to provide the shell with an annular flange at its open end.

13. A machine according to claim 12 in which the mandrel, die roller and collar are shaped to provide the shell with a necked-in portion which is a regular truncated cone, an annular flange at the open end and a regular cylinder between the flange and necked-in portion.

14. A cyclically operable machine for imparting a predetermined configuration to the open ends of thin cylindrical metal shells while spinning the shells about their axes and rolling the configuration, said machine having: spaced coaxial tools for spinning a shell and configuring its open end respectively including a rotatable spindle-mounted chuck for clamping the end of the shell opposite said open end to spin the shell and, for said open end, a rotatable mandrel positionable to engage the inside wall of a shell in opposition to an external die forming roller cooperating with the mandrel to impart said configuration; said tooling including a rotatable collar positionable inside said open end of a shell in contact therewith and a shell support to position the shell between the tools, with the tooling repeated in identical sets at regular intervals about and supported between a pair of rotatable wheels synchronized for rotation about a common axis; a pair of large sun gears mounted for synchronous rotation and having a common variable speed drive to vary the rotational speed thereof independently of the rotational speed of the wheels and wherein said sun gears can be rotated in a direction counter to the direction of rotation of said wheels when faster shell spinning rates are desired and wherein said sun gears can be rotated in the same direction as the rotation of said wheels when slower spinning rates are desired; a pair of pinion gears rotated at the same speed, respectively, by said sun gears; one of said pinions for rotating the spindle of said chuck and the other of said pinions for rotating said collar; and means for feeding the die-forming roller radially toward the mandrel at a preset feed rate when the latter is positioned inside the shell in contact with the inside wall thereof; whereby the speed of the sun gears through the variable speed drive may be varied to produce different spin rates for shells of variant thickness or metallurgy.

15. Machine according to claim 14 in which said mandrel is supported eccentrically at one end of an oscillatable mandrel shaft coaxial with said other pinion gear, an oscillatable gear at the opposite end of said mandrel shaft, and means for oscillating said oscillatable gear to orbit the mandrel into and out of contact with the inside of the shell.

16. Machine according to claim 15 in which the last-named means includes a segment gear meshed with said oscillatable gear, said segment gear being carried by an oscilatable rock shaft, and cam means for oscillating said rock shaft.

17. Machine according to claim 16 in which the cam means for oscillating the rock shaft and the cam means for feeding the die forming roller are located on opposite sides of the wheels and are synchronized with the wheels.

18. Machine according to claim 14 in which the spindle for the chuck is rotatably supported by a cylindrical slide mounted for sliding motion back and forth in a bushing carried by one of the wheels, a cam follower carried by said slide and an annular cam track for said cam follower configured to move the slide back and forth.

19. Machine according to claim 18 in which said annular cam track is positioned between the wheels and is synchronized with the wheels.

20. Machine according to claim 18 in which said one pinion gear for rotating the spindle of said chuck is coaxial with said slide and movable therewith, and a wide idler gear entrained between said one pinion gear and the related sun gear.

21. A machine according to claim 14 in which the mandrel and die roller are shaped to provide the shell with a necked-in portion which is a regular truncated cone.

22. A machine according to claim 14 in which the collar and die roller are shaped to provide the shell with an annular flange at its open end.

23. A machine according to claim 22 in which the mandrel, die roller and collar are shaped to provide the shell with a necked-in portion which is a regular truncated cone, an annular flange at the open end and a regular cylinder between the flange and necked-in portion.

24. A method of configuring in cyclical succession the open ends of cylindrical shells to impart predetermined geometry thereto including the steps of: supporting each shell on its axis between spaced tools constituting a tool set aligned to the axis of the shell, said tools being repeated in sets successively about and supported by a pair of rotating wheels, the tools in each set including a shell support to position a shell between the wheels, a chuck to clamp the shell, a shaft to rotate the chuck, and a rotatable die forming roller positioned externally of the shell combined with an opposed mandrel positionable inside the shell to configure the shell; feeding shells to be configured successively to the shell support while the wheels are rotating; successively advancing each chuck into clamping engagement with a shell on its support and using the chuck to advance the so engaged shell toward the mandrel until the mandrel is inside the shell; spinning the chuck by a gear train which embodies a small driven pinion gear on one of the wheels coupled to the chuck shaft and a large sun drive gear rotating counter to the rotation of the wheels when faster shell spinning rates are desired and rotating in the same direction as the wheels when slower shell spinning rates are desired; and further including the step of rotating the large sun gear by a variable speed drive; engaging the mandrel with the inside wall of the shell to serve as an anvil opposed to the action of the die forming roller and advancing the die forming roller radially into contact with the outside of the spinning shell and progressively inwardly toward the axis of the shell until the end of the shell is configured in cooperation with the mandrel; retracting the chuck and so the configured shell is free of the mandrel; and thereafter discharging the configured shell from its support.

25. A method according to claim 24 in which the shell is configured to embody a regular truncated cone.

26. A method according to claim 24 in which the shell is configured to embody an annular flange.

27. A method according to claim 26 in which the shell is configured to embody a regular truncated cone and a short, regular cylindrical throat between the flange and neck.

28. A method according to claim 24 including the step of supporting the open end of the shell to be configured on a cylindrical support collar and including the step of spinning the support collar at the same speed as the chuck by a gear train which embodies a small driven pinion gear on the other of the wheels, coupled to the collar, and a second larger drive gear rotating counter to the wheels.

* * * * *